US005798138A

United States Patent [19]

Legierse et al.

[11] Patent Number: 5,798,138

[45] Date of Patent: Aug. 25, 1998

[54] METHOD OF SELECTIVELY METALLISING AN INNER, ELECTRICALLY INSULATING SURFACE OF AN OPEN BODY

[75] Inventors: Petrus E. J. Legierse, Eindhoven; Jan W. Severin, Tilburg; Menno B. Kubbinga, Eindhoven; Franciscus A. Meeuwsen, Eindhoven; Antonius F. P. M. Van Veggel, Eindhoven, all of Netherlands

[73] Assignee: U.S. Philips Corporation, New York, N.Y.

[21] Appl. No.: 815,239

[22] Filed: Mar. 12, 1997

[30] Foreign Application Priority Data

Mar. 18, 1996 [EP] European Pat. Off. ..... 96200747

[51] Int. Cl.[6] ..... B05D 1/28; B05D 7/22

[52] U.S. Cl. ..... 427/230; 427/258; 427/304; 427/428; 205/125

[58] Field of Search ..... 427/230, 258, 427/260, 428, 304, 96; 118/211, 212, 214, 215; 101/170; 205/125

[56] References Cited

U.S. PATENT DOCUMENTS 4,209,551 6/1980 Masahi et al. ..... 427/68

4,368,281 1/1983 Brunmett et al. ..... 523/458

5,183,509 2/1993 Brown et al. ..... 118/696

FOREIGN PATENT DOCUMENTS

0592038A1 4/1994 European Pat. Off. .

*Primary Examiner*—Shrive Beck

*Assistant Examiner*—Fred J. Parker

*Attorney, Agent, or Firm*—Robert J. Kraus

[57] ABSTRACT

A method of selectively metallising an inner, electrically insulating surface $S_i$ of an open body (3), comprising the following steps:

(a) providing a roller (2) having a resilient outer surface $S_o$;

(b) providing a layer of a suitable wet ink on the surface $S_o$, according to a given pattern;

(c) causing the roller (2) to roll along the surface $S_i$ so as to impart a patterned layer of wet ink from the surface $S_o$ to the surface $S_i$;

(d) allowing the patterned layer of wet ink imparted to the surface $S_i$ to dry;

(e) selectively depositing metallic material upon the patterned layer of dry ink thus obtained.

Such a method is particularly suited to the manufacture of a scan velocity modulator (1) for use in a cathode ray tube.

6 Claims, 2 Drawing Sheets

METHOD OF SELECTIVELY METALLISING AN INNER, ELECTRICALLY INSULATING SURFACE OF AN OPEN BODY

BACKGROUND OF THE INVENTION

The invention relates to a method of selectively metallising an inner, electrically insulating surface $S_i$ of an open body.

The invention further relates to a scan velocity modulator (SVM) comprising a hollow, substantially cylindrical, electrically insulating housing having an inner cylindrical surface which carries a patterned set of metallic loops.

SUMMARY OF THE INVENTION

The phrase "open body" should here be interpreted as referring to three-dimensional bodies having an outer and an inner surface, neither of which is completely closed. An inner surface of such a body may be flat or curved; in the latter case, the curvature of the surface may, for example, be cylindrical or conical. Examples of such bodies include objects such as open pipes, ducts, sleeves, cans, boxes, and other housings.

A problem with the metallisation of inner surfaces is that, in general, they are not freely accessible to the metallic depository fluxes in such techniques as physical vapour deposition, sputter deposition or laser ablation deposition. On the other hand, although chemical vapour deposition might be a suitable candidate in terms of improved accessibility, its high process temperatures preclude the use of many electrically insulating materials as substrates. In addition, limited accessibility to inner surfaces can hinder the use of masks in attempts at patterned metallisation.

A method as stated in the opening paragraph, and an SVM as described in the second paragraph and obtained using the said method, are known from European Patent Application EP 0 592 038. According to the known method, a planar metallic pattern is provided on (at least) one side of a flexible foil of electrically insulating material, and this foil is then rolled up and affixed to the internal cylindrical surface of a hollow sleeve. Such a metallic pattern may, for example, be provided by depositing a metal layer on (at least) one side of a glass-reinforced epoxy-resin foil (e.g. using physical vapour deposition from a metallic source, or a catalytic layer in conjunction with an electroless Cu bath) and then using a selective masking and etching technique (e.g. lithography) to remove all parts of the metal film outside the confines of a pre-selected pattern. The resulting foil (or foils) can then be laminated, glued or pinned onto any desired part of the inner surface or surfaces of an open body.

In the case of the known SVM, the metallic pattern has the form of two sets of nested rectangular loops, arranged side by side (see FIG. 4 in EP 0 592 038). The foil carrying this pattern is rolled up and mounted in a cylindrical sleeve in such a manner that the two series of nested loops are located diametrically opposite one another. After provision of electrical contacts with the loops, the sleeve may be positioned around the neck of a cathode ray tube, where the said loops can be employed to generate a certain magnetic field configuration.

A disadvantage of the known method is that it is dependent on the use of a carrier foil, whose preparation requires extra process steps, thus entailing extra costs. Since not all materials lend themselves to the manufacture of flexible foils, such a foil may have properties which are not entirely compatible with the requirements of a particular application; for example, a mismatch in the expansion coefficients of the foil and the underlying surface can lead to bulging or cracking of the foil, the foil may have an unacceptably low melting point, or it may have an unsuitable dielectric constant. In addition, allowance must be made for the thickness of the foil, both in the manufacturing procedure and in subsequent applications.

It is an object of the invention to provide an alternative method of selectively metallising an inner, electrically insulating surface $S_i$ of an open body.

This object is achieved in a method which is characterised in that it comprises the following steps:

(a) providing a roller having a resilient outer surface $S_o$;

(b) providing a layer of a suitable wet ink on the surface $S_o$, according to a given pattern;

(c) causing the roller to roll along the surface $S_i$ so as to impart a patterned layer of wet ink from the surface $S_o$ to the surface $S_i$;

(d) allowing the patterned layer of wet ink imparted to the surface $S_i$ to dry;

(e) selectively depositing metallic material upon the patterned layer of dry ink thus obtained.

The procedure enacted in steps (a), (b) and (c) is commonly referred to as "tampon printing", and the procedure performed in step (e) can be referred to as "additive metallisation".

Because it achieves selective metallisation directly on the inner surface itself, without the use of an intermediate flexible foil, the inventive method circumvents the disadvantages discussed above with respect to the known method. In addition, the use of one or more rollers allows the provision of quite complex patterns on the inner surface. Since the employed roller need not be large, patterning can occur on inner surfaces which simply would not be accessible to conventional mask plates. In addition, the inventive metallisation procedure is additive rather than subtractive, so that there is minimal waste of materials.

In a particular embodiment of the inventive method, the ink contains a catalyst which promotes electroless deposition of metals, and step (e) is performed using an electroless procedure. An example of a suitable such ink is an epoxy resin or acrylate resin in which a palladium complex (such as palladium acetate or palladium chloride) has been incorporated. The electroless deposition procedure is performed, for example, by immersing the ink-patterned surface in a bath comprising water, EDTA, NaOH, formaldehyde and a Cu salt (such as $CuSO_4$). In such a bath, additive metallisation of the dry-ink pattern typically proceeds at a rate of the order of 2–5 μm per hour.

An alternative embodiment of the inventive method is characterised in that the ink is electrically conductive, and that step (e) is performed using a galvanic procedure. A suitable example of such an ink is an epoxy resin comprising a metallic substance (such as microscopic silver "filler" particles). The required galvanic deposition can, for example, be performed in an electrolyte containing a Cu salt (such as $CuSO_4$).

In general, the inventors have observed that an electroless procedure tends to yield a higher metallisation quality than a galvanic procedure, e.g. in terms of the numbers of unwanted pores and fine cracks, and the achieved thickness uniformity of the metallic layer.

A preferential embodiment of the method according to the invention is characterised in that the surface $S_o$ of the roller is comprised of rubber. The general term "rubber" is here intended to include more specific substances such as silicone rubber, fluorine silicone rubber, gutta-percha, etc. Alternative materials from which the surface $S_o$, could be comprised include, for example, felt and vinyl. In general, the outer surface $S_o$ of the roller will be cylindrical, regardless of the form of the surface $S_i$. However, if so desired, the surface $S_o$ may also have other forms. For example, it may be conical, particularly if the surface $S_i$ is also conical.

In a particular embodiment of the inventive method, the surface $S_o$ of the roller is substantially smooth and uniform, and step (b) is performed by rolling the surface $S_o$ over a surface P of a process plate (printing block), the surface P containing localised depressions which contain wet ink and are positioned and shaped in accordance with the said pattern. Such a process plate may be made of metal or plastic, for example, and good results are obtained when the localised depressions have a depth of the order of 10–70 μm. Such depressions may be created, for example, using a lithographic or screen-printing procedure in combination with an etching technique.

In an alternative embodiment of the inventive method, the surface $S_o$ of the roller is embossed according to the said pattern, and step (b) is performed by rolling the surface $S_o$ over a pad which is impregnated with wet ink, or over a plate which is covered with a wet ink layer. Such a pad may comprise an absorbent material such as felt or muslin, whereas such a plate may be made of plastic, ceramic or metal, for example. The desired embossed pattern may be obtained, for example, by direct injection moulding, or by selective machining or etching of an unembossed roller surface.

It should be noted that, in any stipulated rolling motion of the roller with respect to a given object (more specifically, the said inner surface, process plate, ink pad or ink plate), the object can be kept still and the roller moved, or the roller can be kept still and the object moved, or both the roller and the object can be moved, as desired. The required rolling motion can be enacted by hand or machine.

According to the invention, the surface $S_i$ can be comprised of a wide range of materials. Particular examples with which the inventors have achieved satisfactory results include polycarbonate (PC), polybutylterephthalate (PBT), polyphenylene oxide (PPO), polyetherimide (PEI), polyamine (PA) and polyethersulfone (PES), for example. In the case of a resin-based ink used in conjunction with such substrate materials, the inventors have observed that the surface $S_i$ does not require prior treatment with any form of adhesion promoter. It should be noted that only the surface $S_i$ need be electrically insulating: the rest of the open body outside of the surface $S_i$ can, for example, be metallic, or can comprise a material other than that of the surface $S_i$.

The invention also relates to an SVM as specified in the second paragraph, which is characterised in that the patterned set of metallic loops is provided directly upon the inner cylindrical surface of the housing, without the presence of an intermediate foil. Further details of the construction of such an SVM will be given hereunder in the Embodiments.

Besides its use in the manufacture of an SVM, the inventive method has many other possible applications. For example, it may be employed in the manufacture of general Moulded Interconnection Devices (MIDs), to create purely decorative metallisations, or to apply type-numbers and manufacturer's codes to the inner surfaces of a whole spectrum of housings and other products.

BRIEF DESCRIPTION OF THE DRAWING

The invention and its attendant advantages will be further elucidated with the aid of exemplary embodiments and the accompanying schematic drawings, whereby.

DESCRIPTION OF THE PREFERRED EMBODIMENTS

Embodiment 1

FIGS. 1–4 depict various aspects of the method according to the invention. In particular, the Figures show various steps in the manufacture of a scan velocity modulator (SVM) 1 according to the invention. Corresponding features in the various Figures are denoted by the same reference symbols.

Figure 1:
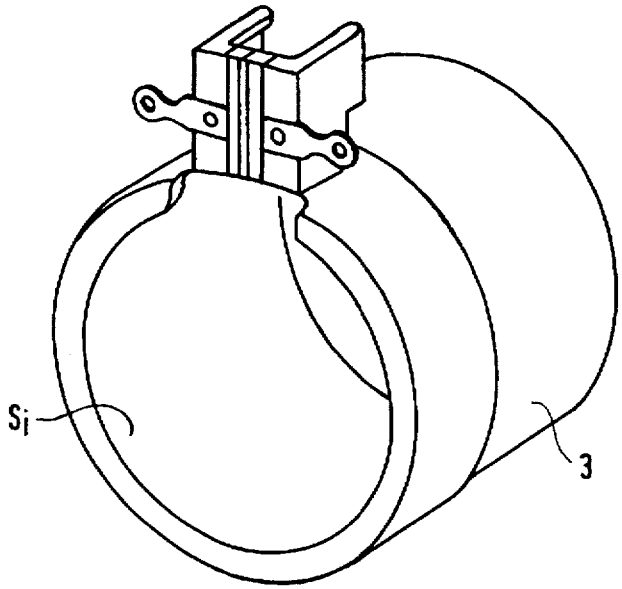
FIG. 1 renders a perspective view of a plastic sleeve having an inner surface which is to be selectively metallised.

FIG. 1 renders an elevational view of an open body 3 having an inner, electrically insulating surface $S_i$. In this particular case, the body 3 has the form of a hollow cylindrical sleeve. The surface $S_i$ is cylindrical, with a radius $r_i$ of approximately 20 mm and a length (parallel to its cylindrical axis) of approximately 35 mm. The body 3 is comprised of polycarbonate, and the thickness of its cylindrical walls is approximately 0.8 mm. The aim of the invention in this case is to provide the surface $S_i$ with a particular pattern of metallic loops, thereby enabling the body 3 to be used as a scan velocity modulator.

Figure 2:
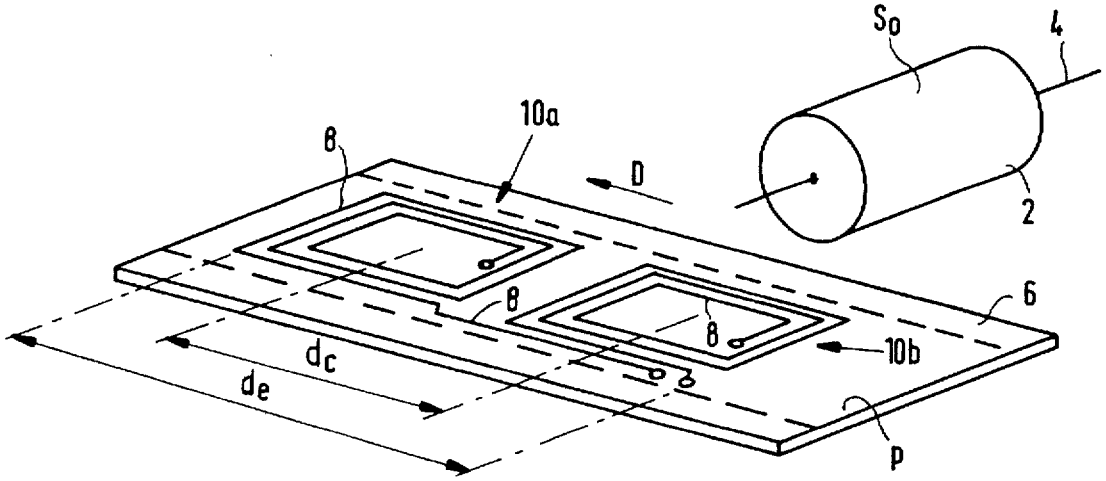
FIG. 2 is a perspective drawing of a roller and process plate suitable for use in step (b) of the inventive method.

FIG. 2 depicts a smooth cylindrical roller 2 having a cylindrical outer surface $S_o$. The roller 2 is, in this case, comprised of silicone rubber, and can be rotated about a cylindrical axis 4. The surface $S_o$ has a radius $r_o \approx 12.5$ mm.

Also depicted is a process plate 6 having a surface P which is provided with localised linear depressions (tracks) 8 according to a given pattern. In this case, the pattern has the form of two similar sets 10*a*, 10*b* of nested loops, situated side by side. The plate 6 is comprised of stainless steel, for example. The depressions 8 can be created with the aid of a wet etching process (e.g. using iron chloride) in conjunction with a patterned mask. Each track 8 has an in-plane width of approximately 450 μm, and a depth of approximately 40 μm.

The depressions 8 are filled with a suitable wet ink, such as OMNISHIELD PRIMER XP-8981-1 (SHIPLEY), BAYPRINT (BAYER) or SENSUL (SENSY), for example. These inks comprise a palladium complex, making them suitable for catalytic electroless metallisation. The depressions 8 can be filled by raking some ink over the surface P using a squeegee. In the particular case depicted in FIG. 2, where the depressions 8 comprise series of tracks which are mutually parallel or perpendicular, such raking is best performed in a direction which subtends an angle of about 30°–60° with the direction D.

When the roller 2 is rolled over the surface P in the direction D (at a speed of the order 1–5 cm/s, for example), ink from the depressions 8 adheres to the roller surface $S_o$. If the circumference of the surface $S_o$ ($=2\pi r_o$) is larger than the extremal pattern length $d_e$ (in the direction D), then the pattern will be inked onto the roller surface $S_o$ without overlap.

Figure 3:
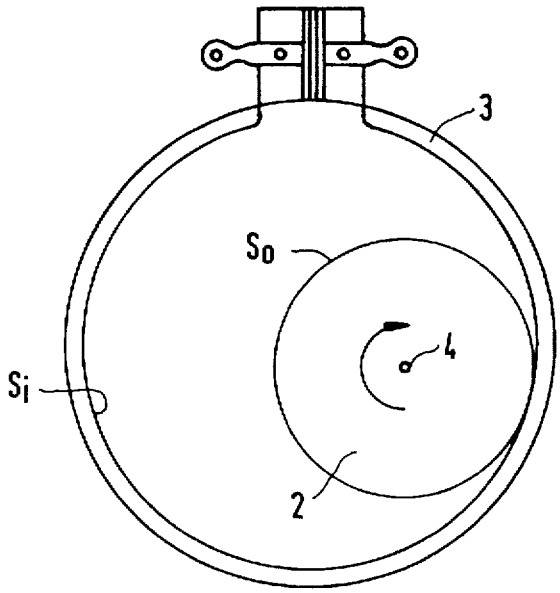
FIG. 3 is an elevational view of the subject of FIG. 1, during enaction of step (c) of the inventive method.

FIG. 3 shows a subsequent process step, performed while the ink on the roller surface $S_o$ is still wet. The surface $S_o$ is brought into contact with the inside surface $S_i$ of the body 3, in such a manner that the cylindrical axes of the roller 2 and body 3 are parallel. This contact is established at a pre-selected location on the surface $S_i$, and the roller is also pre-rotated so that the wet-ink pattern on the surface $S_o$ has the desired starting orientation with respect to the surface $S_i$. Once contact has been established, the roller 2 is rolled (in one direction, and in a single rotation) over the surface $S_i$, so that the wet-ink pattern is transferred from the surface $S_o$ to the surface $S_i$, at the desired location.

In this case, it is the intention that the pattern transferred to the surface $S_i$ be such that the nested-loop set 10*a* is located diametrically opposite the nested-loop set 10*b* within the sleeve 3. With reference to FIG. 2, the distance $d_c$, (parallel to the direction D) between the respective centres of the sets 10*a* en 10*b* should therefore be equal to one half of the circumference of the surface $S_i$, i.e. $d_c=\pi r_i$.

Figure 4:
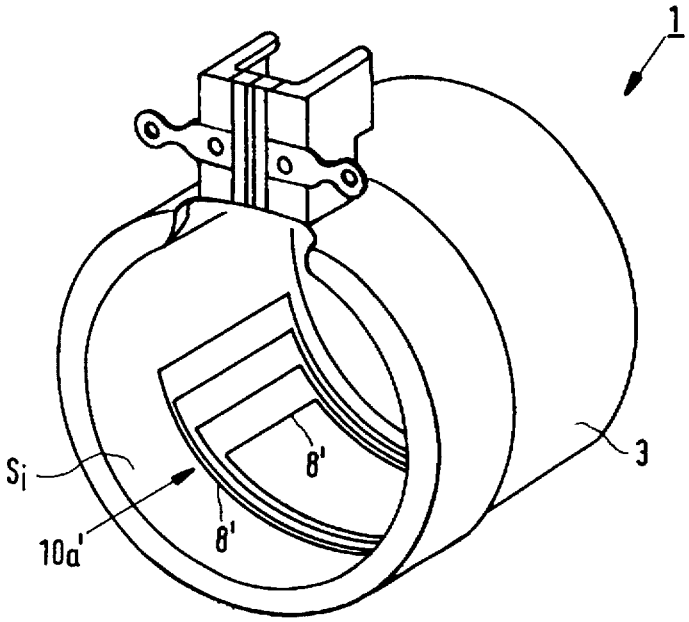
FIG. 4 renders an elevational view of a scan velocity modulator in accordance with the invention, and depicts the subject of FIG. 3 after completion of steps (c), (d) and (e) of the inventive method.

FIG. 4 partially depicts the desired pattern configuration on the inner surface $S_i$ of the sleeve 3. One of the loop-sets 10*a*' is (partially) visible in the Figure. The other loop-set 10*b*' is located diametrically opposite set 10*a*', but is here eclipsed by the wall of the sleeve 3.

Once the wet-ink pattern has been provided on the surface $S_i$, it can be dried (hardened) either thermally or using ultra-violet radiation. Thereafter, the dry-ink pattern is metallised using an electroless procedure. To this end, the sleeve 3 is immersed in a bath (at 45° C.) containing CUPOSIT 251 liquid (SHIPLEY), being an aqueous mixture of $CuSO_4$ (2 g/l), formaldehyde (3 g/l), EDTA (35 g/l) and NaOH (7.5 g/l), together with some stabilisers and other additives (the figures between brackets being approximate concentrations). The result of such immersion is that the dry ink on the surface $S_i$ becomes metallised with Cu, whereas portions of the surface $S_i$ outside the dry-ink pattern do not become metallised. Typically, metallisation proceeds at a rate of about 3–4 μm per hour.

After metallisation to a thickness of approximately 35 μm, the sleeve 3 can be removed from the metallisation bath, rinsed and dried. The result is the SVM 1 depicted in FIG. 4. In numerous trial runs, the inventors have observed that such an SVM can be manufactured at a considerably lower cost than SVMs manufactured using the techniques known from the prior art.

Embodiment 2

In an embodiment otherwise identical to Embodiment 1, the roller 2 is replaced by a roller having a surface $S_o$ which is embossed according to the pattern of depressions 8 shown in FIG. 2. The height of the embossed portions on such a roller 2 need only be of the order of 50 μm.

An embossed roller 2 of this type can, for example, be manufactured by rolling up the process plate 6 in FIG. 2 into a cylindrical drum (with the depressions 8 on the inside), and subsequently using this drum as a mould for an injection moulding procedure.

The embossed surface $S_o$ of such a roller can, for example, be inked by rolling it over an ink-soaked felt pad, or a plate (metal or plastic) which is covered with a thin layer of ink.

We claim:

1. A method of producing an electrically conductive circuit arrangement on a curved, electrically insulating inner surface $S_i$ of a tubular housing having an open end, said method comprising the following steps:

(a) providing a roller having a resilient outer surface $S_o$;

(b) providing a layer of ink on the outer surface $S_o$ of the roller, in a circuit pattern, said ink consisting essentially of a catalyst which promotes electroless deposition of metals or of an electrically-conductive material;

(c) with the roller inserted into the housing through said open end, causing the roller to roll along the inner surface $S_i$ so as to transfer a layer of the ink from the surface $S_o$ to the surface $S_i$, in the circuit pattern;

(d) allowing the transferred layer of ink on the surface $S_i$ to dry;

(e) selectively depositing metallic material upon the transferred layer of dry ink.

2. A method according to claim 1, where the ink contains a catalyst which promotes electroless deposition of metals, and where step (e) is performed using an electroless procedure.

3. A method according to claim 1, where the ink is electrically conductive, and where step (e) is performed using a galvanic procedure.

4. A method according to claim 1, where the surface $S_o$ of the roller comprises of rubber.

5. A method according to claim 1, where the surface $S_o$ of the roller is substantially smooth and uniform, and where step (b) is performed by rolling the surface $S_o$ over a surface P of a process plate, the surface P containing localised depressions which contain said ink and are positioned and shaped in accordance with the circuit pattern.

6. A method according to claim 1, where the surface $S_o$ of the roller is embossed with said circuit pattern, and where step (b) is performed by rolling the surface $S_o$ over a pad which is impregnated with said ink, or over a plate which is covered with a layer of said ink.

* * * * *